United States Patent [19]

Pimentel et al.

[11] 4,299,049

[45] Nov. 10, 1981

[54] SHAPE-SIMULATING TOY

[75] Inventors: Gary W. Pimentel, Fountain Valley; Jeffrey B. Poznick, La Crecenta; Robert W. Atwood, Whittier, all of Calif.

[73] Assignee: Mattel, Inc., Hawthorne, Calif.

[21] Appl. No.: 120,249

[22] Filed: Feb. 11, 1980

[51] Int. Cl.[3] ..... A63H 33/28

[52] U.S. Cl. ..... 46/8

[58] Field of Search ..... 46/6, 7, 8; 40/408

[56] References Cited

U.S. PATENT DOCUMENTS

| | | | |
|---|---|---|---|
| 1,418,755 | 6/1922 | Voelchert | 46/6 |
| 2,133,499 | 10/1938 | Dolan | 46/8 X |
| 3,002,314 | 10/1961 | Brottman | 46/6 |
| 3,590,515 | 7/1971 | Clark et al. | 46/6 |
| 3,925,923 | 12/1975 | La Fata | 46/7 |

*Primary Examiner*—F. Barry Shay

*Attorney, Agent, or Firm*—Reagin & King

[57] ABSTRACT

A toy which generates bubbles and shapes those bubbles into a recognizable form. The toy has a unique pump mechanism which injects air under pressure into a stream of liquid soap then forces the aerated stream through a screen to break up the stream into a multiplicity of bubbles. A removable shaper is arranged at the exit for bubbles from the pump mechanism. The shaper has an exterior which is the incomplete shape of an object recognizable to a child and a series of conduits which conduct the bubbles into porisions in which they complete the recognizable form.

3 Claims, 6 Drawing Figures

SHAPE-SIMULATING TOY

BACKGROUND OF THE INVENTION

This invention relates to toys and, more particularly, to a toy which produces and shapes masses of small bubbles to simulate objects.

There have been many toys suggested by the prior art which contain mechanisms for producing bubbles. For example, U.S. Pat. No. 2,675,644, H. Senior et al, issued Apr. 20, 1954; U.S. Pat. No. 2,839,868, R. A. Lathrop, issued June 24, 1958; U.S. Pat. No. 2,842,894, H. W. Walden, issued July 15, 1958; and U.S. Pat. No. 2,853,829, N. A. Greene, issued Sept. 30, 1958 all disclose various toys which contain a mechanism for blowing bubbles. In each of these toys, however, the object of the toy is to blow one or more bubbles as an end in and of itself. These toys take different forms, however; and often represent a figure (such as a person) which appears to be blowing the bubbles. Another toy which produces bubbles is that disclosed in U.S. Pat. No. 3,590,515, issued July 6, 1971, to the assignee of the present application; this toy is a doll which produces a shampoolike foam in its hair when its sides are squeezed so that the doll appears to be shampooing its hair.

None of the prior art discloses, however, a toy which has a mechanism for producing masses of small bubbles and utilizing those bubbles to produce a recognizable shape.

It is an object of the present invention to provide a new and unique toy which produces masses of small bubbles and to shape those bubbles to provide a recognizable form.

It is another object of this invention to provide an improved mechanism for generating bubbles.

It is another object of this invention to provide a new and improved toy capable of generating and shaping bubbles in a number of recognizable forms.

SUMMARY OF THE INVENTION

The foregoing and other objects of the invention are accomplished by a toy which utilizes a unique mechanism for producing bubbles at an outlet. The toy has a number of different interchangeable shaping devices each of which may be placed over the outlet of the bubble producing mechanism. Each of the shaping devices is molded in a particular form so that it provides an incomplete shape of an object such as a lion or a clown which is recognizable to a child. The bubbles are directed by the shaping devices to complete the form of the recongizable shape.

Other objects, features, and advantages of the invention will become apparent from a reading of the specification when taken in conjunction with the drawings in which like reference numerals refer to like elements in the several views.

DESCRIPTION OF THE PREFERRED EMBODIMENT

Figure 1A:
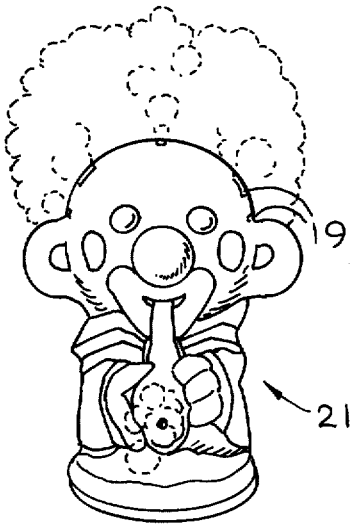
FIG. 1 is a perspective view of a toy constructed in accordance with the invention and showing in FIGS. 1A and 1B various embodiments of shapers to be used with the toy of the invention.
Figure 1B:
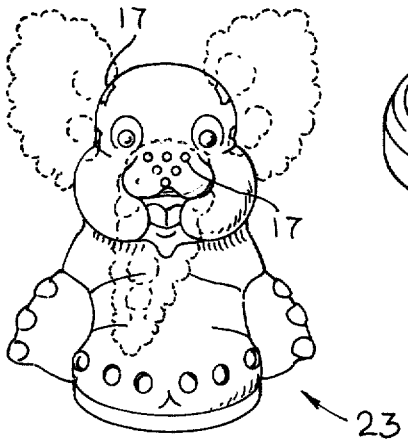
Figure 1:
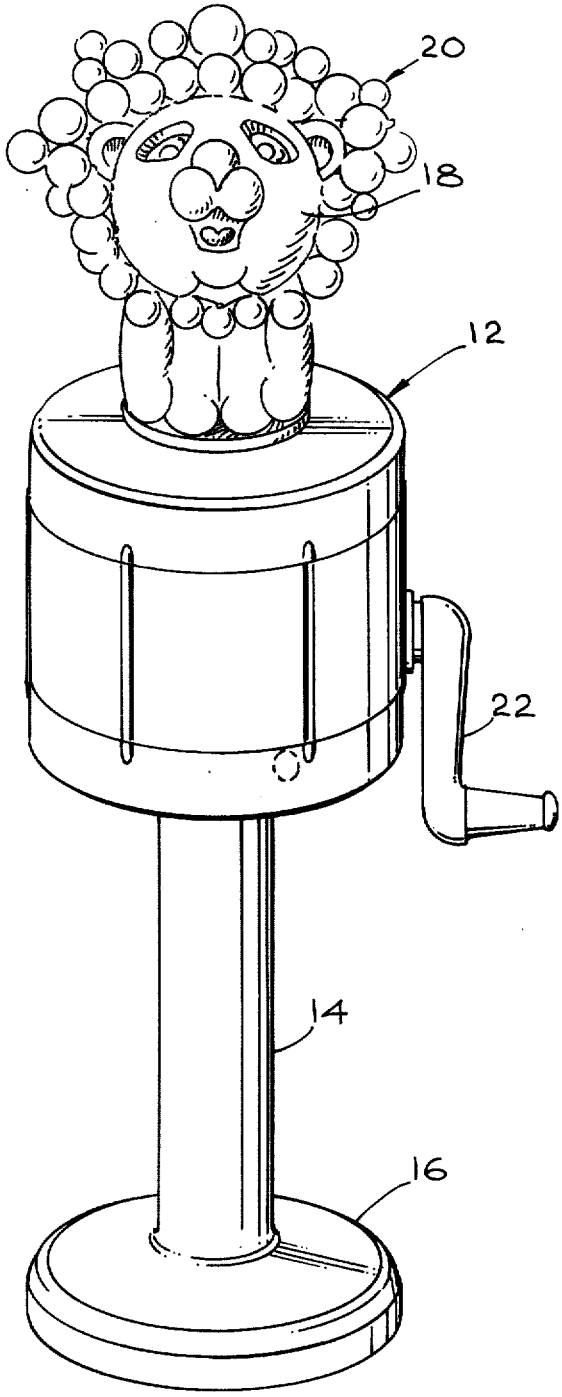

Referring now to the drawings and, more particularly, to FIG. 1, there is shown a toy 10 constructed in accordance with the invention. The toy 10 comprises a bubble generating mechanism 12 of generally cylindrical form mounted upon a pedestal 14 supported by a base 16. The bubble generating mechanism 12 supports a shaper 18 which in a preferred embodiment is molded with an essentially hollow interior and has an exterior form depicting a particular, well recognizable object. In FIG. 1, the object is a lion. The form is incomplete, however; and the shaper 18 has a number of conduits from its interior to its exterior to provide exits for bubbles generated by the mechanism 12. The conduits are arranged in a pattern so that the bubbles escaping the shaper 18 will take a shape to complete the form of the object incompletely depicted by the shaper 18. In the particular embodiment shown in FIG. 1, the form of a lion is completed by bubbles 20 exiting from conduits (not shown in FIG. 1) to form a mane.

The bubble generating mechanism 12 rotatably mounts a handle 22 on its side which is cranked to activate the mechanism 12 to produce the bubbles which form the particular shape desired. The shaper 18 may be removed from the mechanism 12, as will be described hereinafter, and may be replaced by a shaper having a different recognizable but incomplete form and which provides conduits to shape bubbles to complete its particular form.

As shown in FIGS. 1A and 1B, various embodiments of the invention utilize shapers 21 and 23 constructed in the form of a clown which has conduits 19 formed to shape bubbles to complete its hairdo, and in the form of an elephant with conduits 17 formed to shape bubbles to define ears and a trunk. The form of the soap bubble masses for shapers 21 and 23 are shown in dotted lines in FIGS. 1A and 1B. Obviously other forms of shapers might be provided by those skilled in the art without departing from the teaching of the invention.

Figures 2, 3:
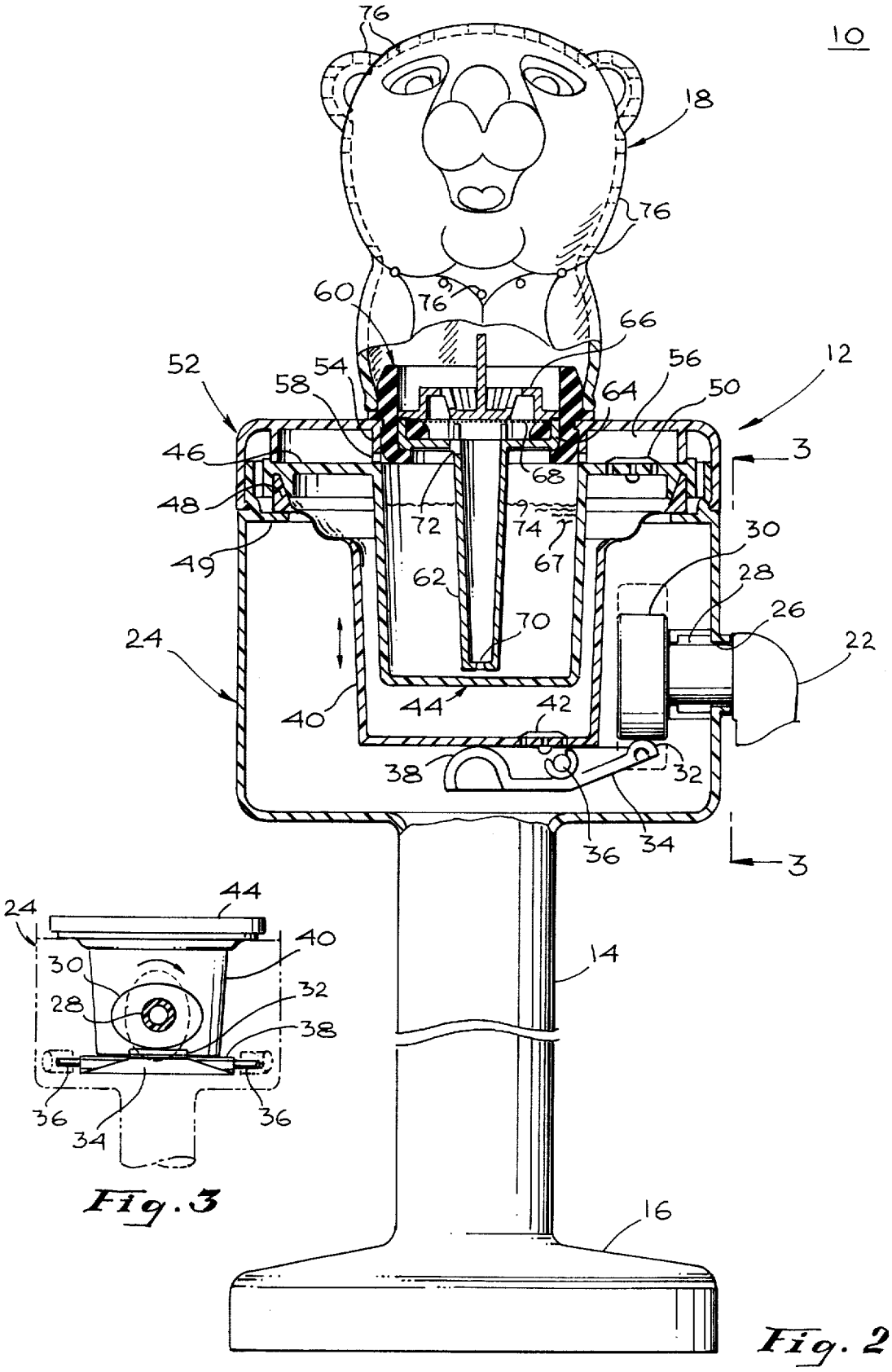
FIG. 2 is a front view in cross-section of the internal mechanism of the toy shown in FIG. 1.
FIG. 3 is a side view, partially in cross-section, of the toy shown in FIG. 1.
Figure 4:
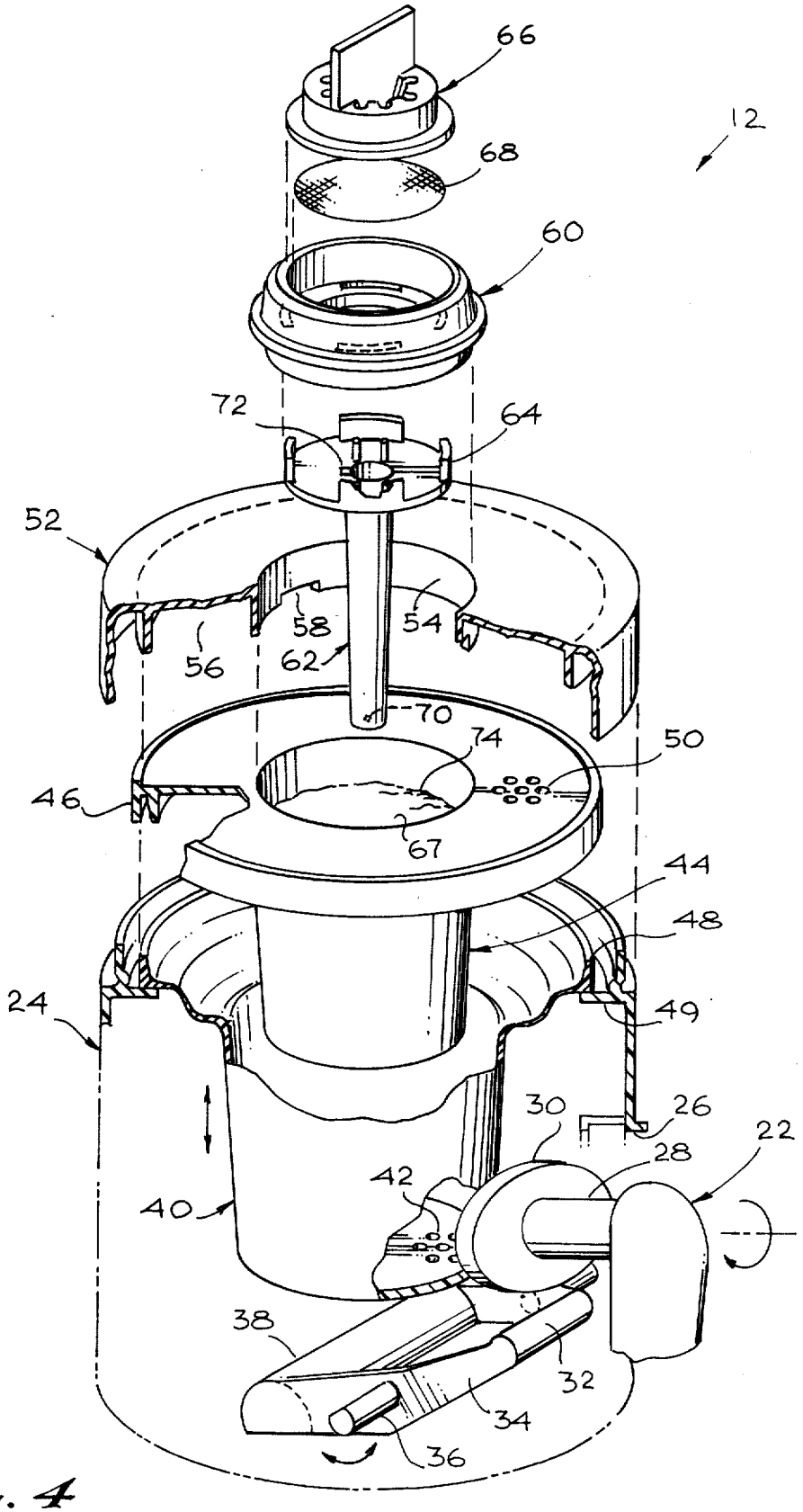
FIG. 4 is an exploded perspective view of the toy shown in FIG. 1.

Referring now to FIGS. 2, 3, and 4, there are shown the details of the toy 10 shown in FIG. 1. As shown in FIG. 1, the toy 10 includes the bubble generating mechanism 12 which is supported upon pedestal 14 and base 16. In the preferred embodiment shown in FIGS. 2–5, the bubble generating mechanism 12, the pedestal 14, and the base 16 are molded from a plastic material such as styrene so that they have a unitary outer housing. For example, as shown in FIG. 2, an outer housing 24 of the mechanism 12 and the outer housings of the base 16 and the pedestal 14 are all molded together in front and rear sections which may be fastened together in a well known manner such as by adhesive bonding. The outer housing 24 of the mechanism 12 has an aperture 26 which rotatably mounts an inner end 28 of the handle 22. The end 28 of the handle 22 terminates in an elliptically shaped cam 30. When the handle 22 is rotated within the aperture 26, the cam 30 provides a reciprocating motion to an end 32 of a shaft 34 against which it bears. The shaft 34 is rotatably mounted to the housing 24 upon an axle 36. The reciprocation of the end 32 of the shaft 34 forces a second end 38 of the shaft 34 to reciprocate against the lower surface of an outer cup 40 mounted within the housing 24. The cup 40 may be constructed of a moldable plastic material such as ethylene vinyl acetate. The upper walls of the cup 40 thin and flare outwardly, then turn upward and outward again, at the upper edge where they are supported by the housing 24. This shape provides a spring which flexes so that the cup 40 may be pushed upward along its axis by the end 38; and when pressure is removed as the end 38 withdraws during reciprocation, the cup 40 springs downwardly along its axis.

The cup 40 has a check valve 42 mounted in its lower surface (which may be any of a number of well known types) positioned to allow the equalization of pressure between the interior of the cup 40 and the exterior thereof when the cup 40 travels in the downward direction as shown in FIG. 2.

Also supported within the housing 24 is an inner cup 44 which may be constructed of a material such as styrene. The cup 44 lacks the flexing properties of the cup 40 and, consequently, remains in position supported by the housing 24 as the cup 40 is moved up and down. The cup 44 has a flange 46 extending outwardly from its upper body which is hermetically fastened, by means well known in the art such as an adhesive bond, to an upper ridge 48 projecting from the cup 40. The lower surface of the ridge 48 is hermetically fixed to an inwardly extending flange 49 projecting from the housing 24. Consequently, there is formed an air pocket within the space between the exterior of the cup 44 and the interior of the cup 40. The flange 46 of cup 44 has positioned on its upper surface a check valve 50 of a type well known in the art arranged to allow the relief of pressure built up between the cups 40 and 44.

Positioned over and sealed to the housing 24 is an upper housing 52 of the mechanism 12 having a downwardly extending cylindrical flange 54. The upper housing 52 is hermetically sealed to the housing 24 and to the flange 46 to provide a chamber 56 into which the check valve 50 exhausts. The chamber 56 exhausts through an aperture 58 in the flange 54 so that an increase in pressure in the chamber 56 will cause an increase in pressure in the interior of the cup 44.

The upper housing 52 has a circular aperture therein through which extends a stopper 60 of a soft rubber-like material. The stopper 60 is removable, forms a seal with the housing 52, and supports a tube 62 which is coaxially aligned with it and depends therefrom. The tube 62 has an upper flange 64 which provides a seal with the stopper 60. The upper flange 64 supports a retainer 66 which is affixed to the flange 64 by means such as sonic welding. Between the flange 64 and the retainer 66 is positioned a screen 68 of a material such as stainless steel having a mesh of from one hundred to one hundred fifty. Alternately, the screen 68 may comprise a cloth material having like characteristics.

The tube 62 has a conduit running axially therethrough which opens at an aperture 70 into the cup 44. The tube 60 also has an aperture 72 which is so configured as to provide an exit for gases both through the flange 64 and into the interior of the tube 62. In use, a liquid soap 67 is placed within the cup 44 by removing the stopper 58. The sizes of the openings of the apertures 70 and 72 are so adjusted that, with a material having a viscosity such as that of the usual liquid soap commercially available, an increase in pressure within the chamber 56 increases the pressure on the upper surface 74 of the liquid soap 67 within the cup 44, forcing the soap 67 through the aperture 70 and up the tube 62. As the soap 67 continues up the tube 62, it receives air through the aperture 72 causing the generation of bubbles within the retainer 66 as the soap 67 passes out of the tube 62 and through the screen 68. This generation of bubbles is enhanced by the air forced through the flange 64.

The increase in pressure on the surface 74 is caused as follows. The handle 22 is rotated causing the cam 30 to bear against the end 32 of shaft 34 rocking shaft 34 back and forth upon its axle 36. The rocking of shaft 34 causes the end 38 to move up and down along the axis of cup 40 forcing the cup 40 to approach and then withdraw from the cup 44. As the cup 40 approaches the cup 44, the check valve 42 is closed by the increase in pressure. This action further increases the pressure between the cups 40 and 44 and ultimately opens the check valve 50 causing an increase in pressure within the chamber 56. This pressure increase is transferred via the aperture 58 into the interior of the cup 44 thereby increasing the pressure on the upper surface 74 of the soap 67. This increase in pressure, as noted above, forces the fluid through the aperture 70 and upward through the tube 62 and forces air through the apertures 72 and 63 to generate bubbles in the fluid as it passes up the tube 62 and through the screen 68 which assists in breaking the fluid into bubbles. As may be seen, the retainer 66 has apertures therein so that the bubbles are forced into the interior of the shaper 18 and ultimately out of the apertures 76 therein. As may be seen in FIG. 2, the apertures 76 are placed so that the bubbles which issue therefrom form in the shape of a mane for the lion shaper 18 shown in the FIG. 2. Consequently, the bubbles exiting from the apertures 76 complete the form of the shaper 18 as the handle 22 is cranked.

As may be seen in FIG. 2, the shaper 18 is positioned over the upper end of the stopper 60 and may be easily removed therefrom simply by an upward pull on the shaper 18. This allows different shapers to be positioned upon the stopper 60 thereby enhancing the use of the toy 10.

In contrast to the shaper 18 shown in FIG. 1, the shaper 21 and 23 shown in FIGS. 1A and 1B have apertures 19 and 17 positioned in such a manner as to produce, respectively, a hairdo for a clown and large ears and a spout for an elephant when the handle 22 is rotated.

In order to produce the arrangement by which the liquid soap moves from the interior of the cup 44 through the apertures 70 and 72 of the tube 62, the aperture 70 is formed with a diameter of approximately 0.040 inches, and the aperture 72 has a rectangular cross section opening into the cup 44 of approximately 0.030 inches by 0.030 inches. This embodiment of the mechanism works well with a solution of "Miracle Bubbles Number 8111", sold by Imperial Toy Corporation.

While there has been shown and described a preferred embodiment of the invention, it is to be understood that various other adaptations and modifications may be made by those skilled in the art without departing from the spirit and scope of the invention.

What is claimed is:

1. A toy comprising a bubble generator; and means for shaping bubbles generated by the bubble generator into recognizable forms, the bubble generator including:

a pump having a first generally-cylindrical cup, a second cup located within the first cup, means for mounting the first and second cups to form a hermetically sealed volume therebetween and to allow movement of the first cup along its cylindrical axis relative to the second cup, a first check valve in the first cup positioned to open as the two cups recede from one another, and a second check valve communicating with the hermetically sealed volume and positioned to open as the two cups approach one another, means for actuating the pump including means for causing the two cups to approach and recede from one another, means for moving a fluid which may be formed into bubbles in response to the action of the pump, and means for injecting a gas into the fluid.

2. The toy of claim 1 in which the means for moving a fluid comprises means for directing gases exhausted by the second check valve from the hermetically sealed volume into the second cup, and the means for injecting a gas into the fluid comprises an aperture from the second cup leading to a fluid path, and further comprising means for establishing the fluid path between the second cup and an exterior opening of the bubble generator.

3. The toy of claim 2 in which the means for shaping bubbles includes a figure having an exterior surface formed into a recognizable shape, a hollow interior, an opening in the exterior surface communicating with the hollow interior, the opening adapted to sealably mate with the exterior opening of the bubble generator, and conduits leading from the hollow interior to the exterior surface of the figure, the conduits located so that bubbles exiting therefrom add to the recognizable shape.

* * * * *